US006543062B1

(12) United States Patent
Amsel et al.

(10) Patent No.: US 6,543,062 B1
(45) Date of Patent: Apr. 8, 2003

(54) PANTS GARMENT WITH BODY PROFILE ENHANCEMENT FEATURES

(75) Inventors: Fortuna Amsel, Caracas (VE); Simon Amsel, Caracas (VE)

(73) Assignee: Minelli Modas, C.A., Caracas (VE)

( * ) Notice: Subject to any disclaimer, the term of this patent is extended or adjusted under 35 U.S.C. 154(b) by 0 days.

(21) Appl. No.: 10/093,968

(22) Filed: Mar. 11, 2002

(51) Int. Cl.[7] ..... A41D 1/06
(52) U.S. Cl. ..... 2/227; 2/237
(58) Field of Search ..... 2/227, 228, 211, 2/212, 236, 237, 220, 221, 234, 235, 82, 69, 79, 400, 401, 405; 450/155

(56) References Cited

U.S. PATENT DOCUMENTS

| | | | | | |
|---|---|---|---|---|---|
| 39,584 | A | | 8/1863 | Osler | |
| 620,435 | A | | 2/1899 | Fisher | |
| 1,902,895 | A | * | 3/1933 | Smith | 2/237 |
| 2,099,238 | A | * | 11/1937 | Simpson | 2/237 |
| 2,663,025 | A | | 12/1953 | Isaac | |
| 2,742,647 | A | | 4/1956 | Khalil | |
| 2,997,044 | A | | 8/1961 | Simons | |
| 3,068,871 | A | | 12/1962 | Rapp | |
| 3,089,149 | A | * | 5/1963 | Kelleam | 2/237 |
| 3,099,014 | A | * | 7/1963 | Smith | 2/237 |
| 3,127,896 | A | | 4/1964 | Puliafico | |
| 3,185,158 | A | * | 5/1965 | Gattuso | 2/237 |
| 3,234,947 | A | | 2/1966 | Bergstein | |
| 3,246,342 | A | | 4/1966 | Pagano | |
| 3,457,926 | A | | 7/1969 | Bacon et al. | |
| 4,004,297 | A | | 1/1977 | Polack | |
| 4,069,513 | A | | 1/1978 | Shiller et al. | |
| 4,389,957 | A | | 6/1983 | Block et al. | |
| 4,494,546 | A | | 1/1985 | Steiman | |
| 4,581,771 | A | | 4/1986 | Williams | |
| 4,587,675 | A | | 5/1986 | Prouty | |
| 4,653,122 | A | | 3/1987 | Zanoni | |
| 4,669,130 | A | | 6/1987 | Brown | |
| 4,875,240 | A | | 10/1989 | Barrett | |
| 4,890,337 | A | | 1/1990 | Greenberg | |
| 4,989,272 | A | | 2/1991 | Wagner | |
| 5,127,108 | A | | 7/1992 | Weiss | |
| 5,144,697 | A | | 9/1992 | Sandbeck | |
| 5,295,267 | A | | 3/1994 | Galindo | |
| 5,535,451 | A | | 7/1996 | Tassone et al. | |
| 5,539,926 | A | | 7/1996 | Mantos | |
| 5,752,873 | A | | 5/1998 | Morris | |
| 5,978,963 | A | | 11/1999 | Moskowitz et al. | |
| 6,035,448 | A | | 3/2000 | Thomson | |
| 6,041,437 | A | | 3/2000 | Barker et al. | |
| D425,687 | S | | 5/2000 | Gonzalez | |
| 6,058,514 | A | | 5/2000 | Hart | |
| 6,062,946 | A | | 5/2000 | Rosenberg | |
| 6,146,240 | A | | 11/2000 | Morris | |
| 6,182,297 | B1 | | 2/2001 | Duren et al. | |
| 6,205,591 | B1 | | 3/2001 | Wheeler et al. | |
| 6,243,880 | B1 | | 6/2001 | Lyden | |
| 6,292,950 | B1 | | 9/2001 | Mentone | |
| 6,311,333 | B1 | | 11/2001 | Batra | |
| D453,604 | S | | 2/2002 | Hart | |
| 6,367,086 | B1 | | 4/2002 | Woodard | |

* cited by examiner

*Primary Examiner*—Gloria M. Hale
(74) *Attorney, Agent, or Firm*—Banner & Witcoff, Ltd.

(57) ABSTRACT

A pants garment may be formed with a high back and low front to accentuate the buttocks of the wearer. A pants garment can include elastic panels along a front to draw in the wearer's stomach and pull on the rear to lift the buttocks. The garment can be formed of a shape recovery material that cooperates with the elastic panels to assist in lifting of the buttocks. A pants garment can be formed primarily of two mirror image sections that are interconnected along the front and rear seams. The rear seams may include a concave curved segment in a crotch in which the slope of the curved segment extends away from the waist of the garment. The legs of each section has a tubular configuration with a single seam extending along an inner side. A seamless outer surface cooperates with the shape recovery material to lift the buttocks.

35 Claims, 6 Drawing Sheets

PANTS GARMENT WITH BODY PROFILE ENHANCEMENT FEATURES

FIELD OF THE INVENTION

Aspects of the present invention are generally directed to an article of clothing. More particularly, the aspects of the present invention relate to a pants garment with human body profile enhancement features.

BACKGROUND OF THE INVENTION

Many individuals diet and exercise in an attempt to shape their bodies. Unfortunately, many women and men find they cannot shape their profile to reverse the aging process, effects of gravity, or their genetic features. Some have resorted to cosmetic surgery to shape the bullocks, hips, or thighs. These procedures, however, are very costly, can create scaring, and have other undesirable problems.

The fashion and textile industries provide pants to consumers for different purposes. Women are a segment of consumers who generally desire clothing that make them look and feel good by shaping their bodies. For many reasons, including a desire to shape their bodies, some women wear foundation garments under their clothing, for example girdles and panty, hosiery. Unfortunately, layers of foundation garments with other clothing can be uncomfortable for some wearers and unsightly with some styles of clothing (e.g., those using stretch fabrics).

There has been some effort to produce clothing with built-in foundation garm ents. These built-in garments have drawbacks, including constructions which merely hold-in a stomach or the bullocks of a wearer's body. For example, U.S. Pat. No. 3,068,871 to R. Rapp illustrates toreador pants with a built-in panty that merely squeezes and holds in portions of the stomach. Further, U.S. Pat. No. 3,127,896 to Puliafico; U.S. Pat. No. 3,234,947 to Bergstein; U.S. Pat. No. 3,246,342 to Pagano; and more recently U.S. Pat. No. 6,035,448 to Thompson describe slacks with built-in girdles that also merely hold in the stomach. These constructions are ill-suited for consumers who may want garments that accentuate their body shape, instead of only squeezing or holding the stomach or the buttocks.

In an effort to enhance a user's profile without foundation garments, U.S. Pat. No. 5,535,451 to Tassone et al. ("Tassone") describes a pants garment wherein the legs are narrowed to squeeze the thighs of a wearer in an effort to urge the buttocks upward. This construction is uncomfortable and ill-suited for some wearers, and provides only marginal benefit in enhancing the user's profile. Moreover, Tassone uses conventional side seams on the leg portions which are formed with overlapping material inside of the pants garment. This construction causes a discontinuation of the stretch surface encircling the leg, which reduces the capabilities of the pants and detracts from the enhanced appearance being sought.

Recently, jeans composed of denim and blends with elastic fibers have been popular sellers because of their comfort and improved styling. However, none in the market include a body profile enhancing system, particularly for the abdominal and gluteal region of a wearer. Moreover, due to the stretch nature of the material, foundation garments used to offset profile changes are not usually suitable because their outline typically shows through the stretched fabric creating an unappealing affect.

SUMMARY OF THE INVENTION

The present invention pertains to a pants garment that enhances the anatomic shape of a lower torso of a human body and provides an improved anatomical fit. Moreover, in a preferred aspect of the invention, the pants garment provides an enhanced human body profile with a natural appearance of the fit on the body and a high level of comfort.

The pants garment of the present invention is able to enhance the wearer's profile in a attractive style without the need for form adjusting foundation garments, which is typically bulky, uncomfortable and unsightly in close fitting garments or garments composed of shape recovery material, such as stretch denim.

In one aspect of the invention, the pants garment is provided with a unique cut and assembly that lifts and accentuates the wearer's buttocks. In another preferred aspect of the invention the pants garment additionally reduces the wearer's stomach.

In another aspect of the invention, the pants garment is formed with a high back and low front to better highlight and accentuate the buttocks of the wearer.

In another aspect of the invention, the pants garment includes elastic panels along a front of the torso portion to draw in the wearer's stomach and pull on the rear portions of the garment to better lift and accentuate the buttocks. The elastic panels are formed to be taut when the pants garment is fastened about the wearer. In one preferred construction, the pants garment is formed of a shape recovery material, such as stretch denim, to maximize the effectiveness of the elastic panels.

In another aspect of the invention, the pants garment is formed primarily of two mirror image sections that are interconnected along the front and rear seams. The leg portions of each section have a tubular configuration with a single seam extending along an inner side thereof. The seamless outer surface provides an attractive streamline appearance, and when used with shape recovery material is able to maximize the benefits of the stretch material in fitting about the user's body. In this way, the invention is able to provide a natural fit appearance of the garment about the wearer's body despite providing profile enhancing features.

In another aspect of the invention, the pants garment is formed of right and left sections that include rear edges that are interconnected at the rear seam of the garment. The rear edges each include a concave curved segment in the crotch portion wherein the slope of the curved segment extends away from the waist portion of the garment. The use of this cut helps lift and accentuate the buttocks into an enhanced profile.

In a preferred construction, the aspects of the invention are combined into an improved jean garment that is composed of right and left sections that uniquely lift and accentuate the wearer's buttocks by having a novel cut along the rear edges forming the rear seam, forming the waist portion highest at the back of the wearer and lowest at the front, including elastic panels along the front of the garment to reduce the wearer's stomach and further lift the buttocks, using shape recovery material, and forming the leg portions with a single inner seam. The use of any or all of the aspects of the invention in a pants garment provides an improved anatomical profile of the wearer.

The ability of the inventive pants garment to provide an improved anatomical profile in a comfortable construction, without the need for form adjusting foundation garments, is a significant advance in the garment industry. The ability to improve ones appearance is a high priority for many people. Many, and in particular teenage girls, can experience an improved self-image with the enhanced body profile provided by the pants garment of this invention.

The elimination of the outer seams further reduces the labor and time of assembly of the pants garments by as much as 50%. The actual time savings will depend on the operation of the plant and the use of other secondary pieces such as a waistband, a yoke, pockets, belt loops, etc.

The above and other aspects, features and advantages of the present invention will be readily apparent and fully understood from the following detailed description of preferred embodiments.

BRIEF DESCRIPTION OF THE DRAWINGS

The foregoing summary of the invention, as well as the following detailed description of preferred embodiments, is better understood when read in conjunction with the accompanying drawings, which are included by way of example, and not by way of limitation with regard to the claimed invention.

DETAILED DESCRIPTION OF THE PREFERRED EMBODIMENTS

Figure 1:
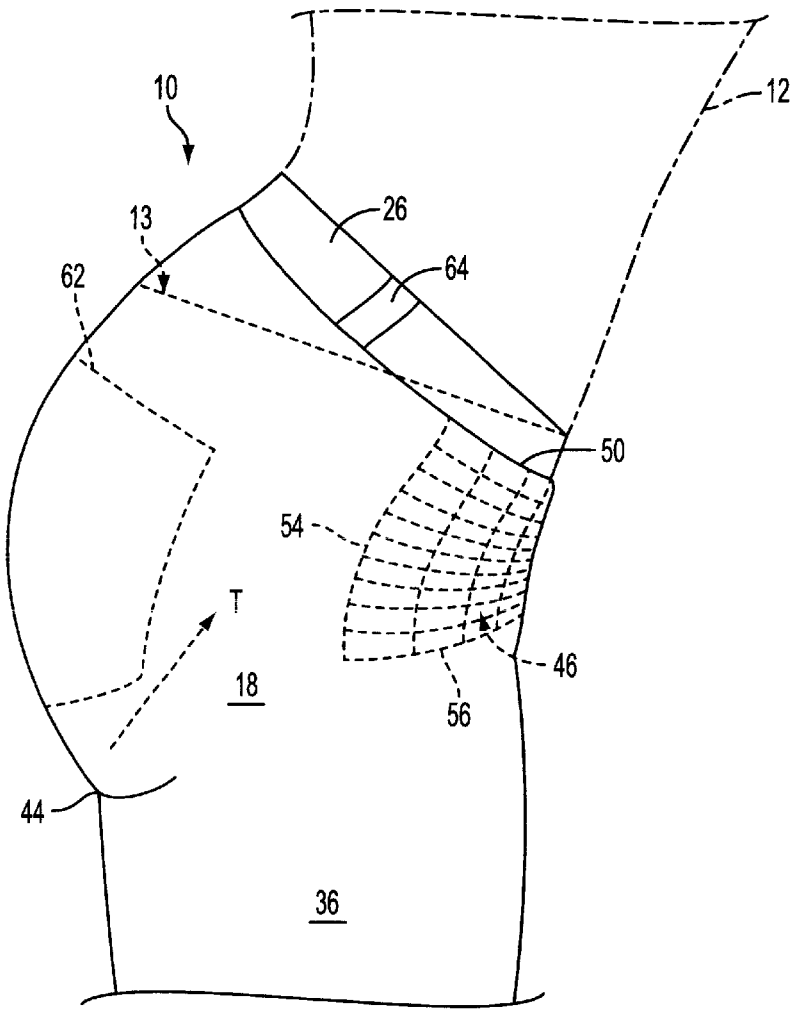
FIG. 1 is a schematic partial side elevational view of an embodiment a pants garment worn on a human body according to the teachings of the present invention.
Figure 2B:
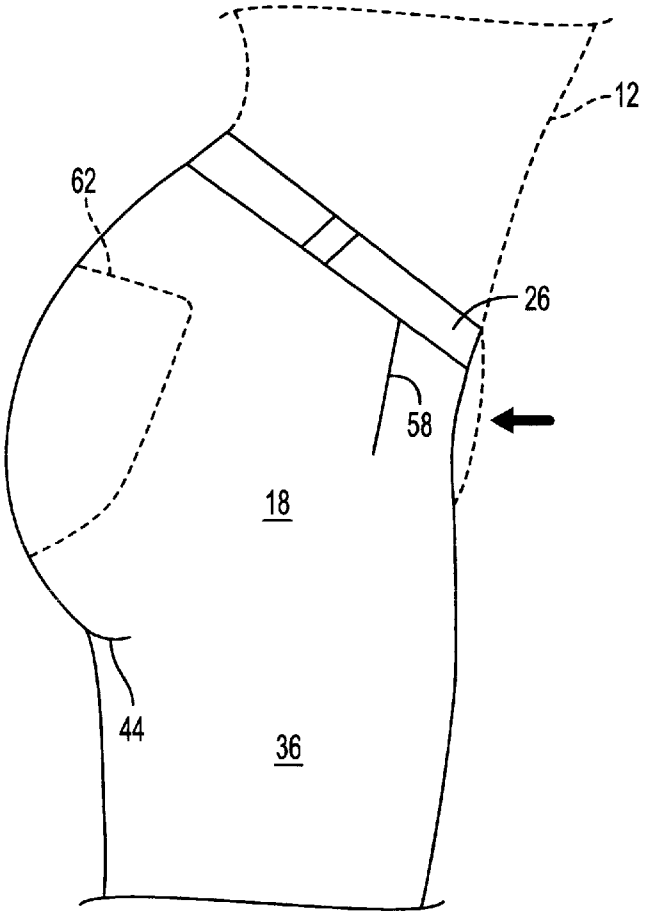
FIG. 2B is a schematic partial side elevational view of the pants garment shown in FIG. 1 forming a protruding gluteal region and compressing the abdominal region of the human body.
Figure 2A:
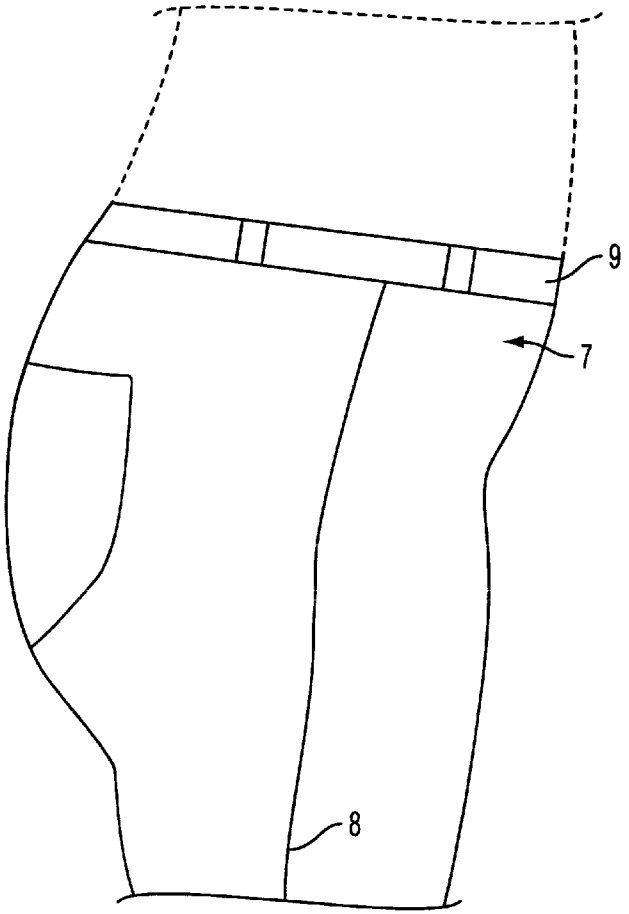
FIG. 2A (PRIOR ART)
FIG. 2A is a schematic partial side elevational view of a conventional pants garment on a wearer.

As used herein the term "pants garment" refers to clothing that covers the lower body region including the hip and legs, for example, slacks, trousers, jeans, shorts, etc.

FIGS. 1, and 2B–6 illustrate an article of clothing for enhancing the anatomic shape of a human body particularly in the lower torso and legs of a woman. The article of clothing is generally referred to herein as a pants garment 10. In one aspect, shown in FIGS. 1 and 2B, the pants garment 10 includes body profile enhancement features, which simultaneously flatten the lower abdominal region and raise the anatomy of the gluteal region of a human body 12 when the pants garment is properly sized and worn. This is in contrast to the performance of conventional pants 7 shown in FIG. 2A. The pants 7 have a protruding stomach and no lifting and shaping of the gluteal region of a woman. Additionally, conventional pants 7 have a side seam 8, and the waist 9 is horizontal which provides no benefit for the enhancing the rear-anatomy of a wearer.

Figure 3:
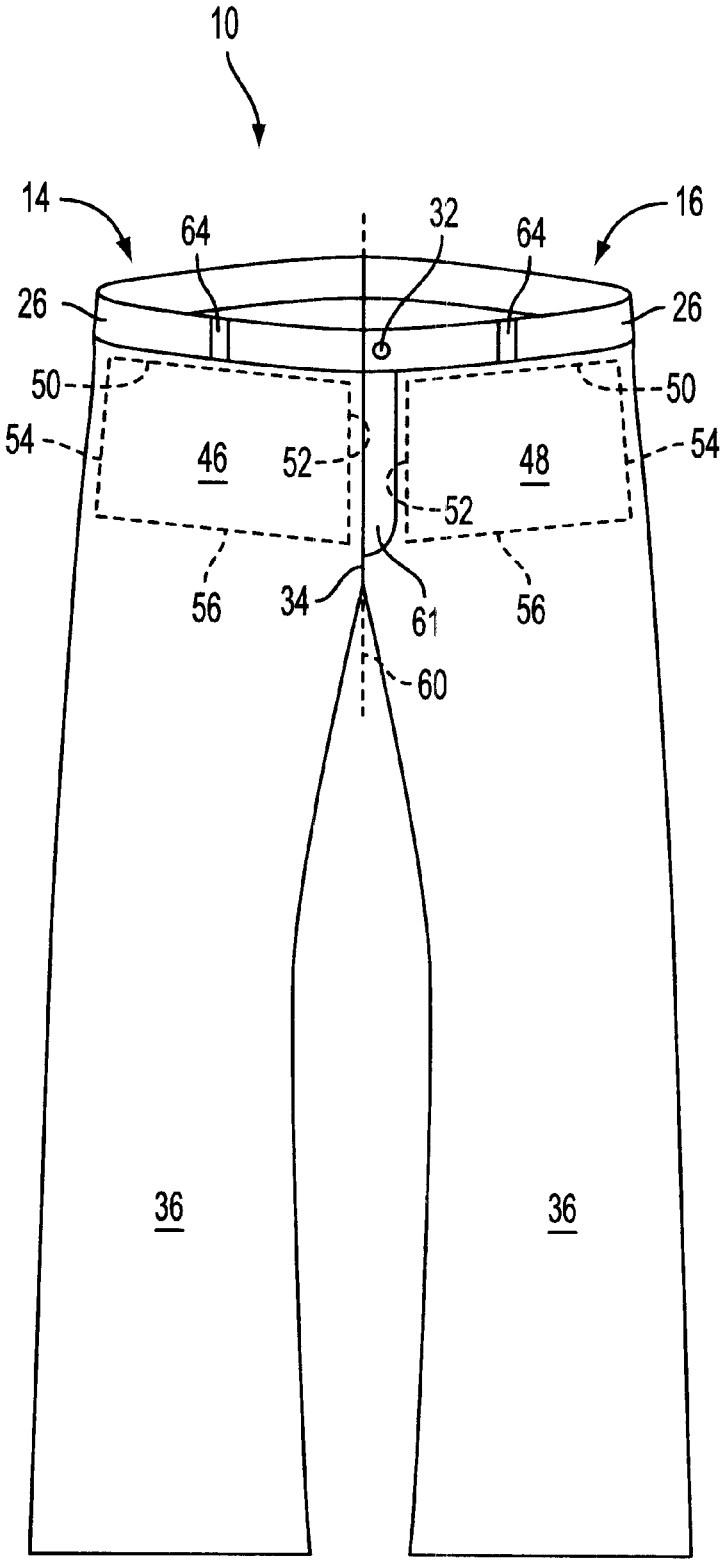
FIG. 3 is a schematic front elevational view of an embodiment of an assembled pants garment according to the teachings of the present invention.
Figure 4:
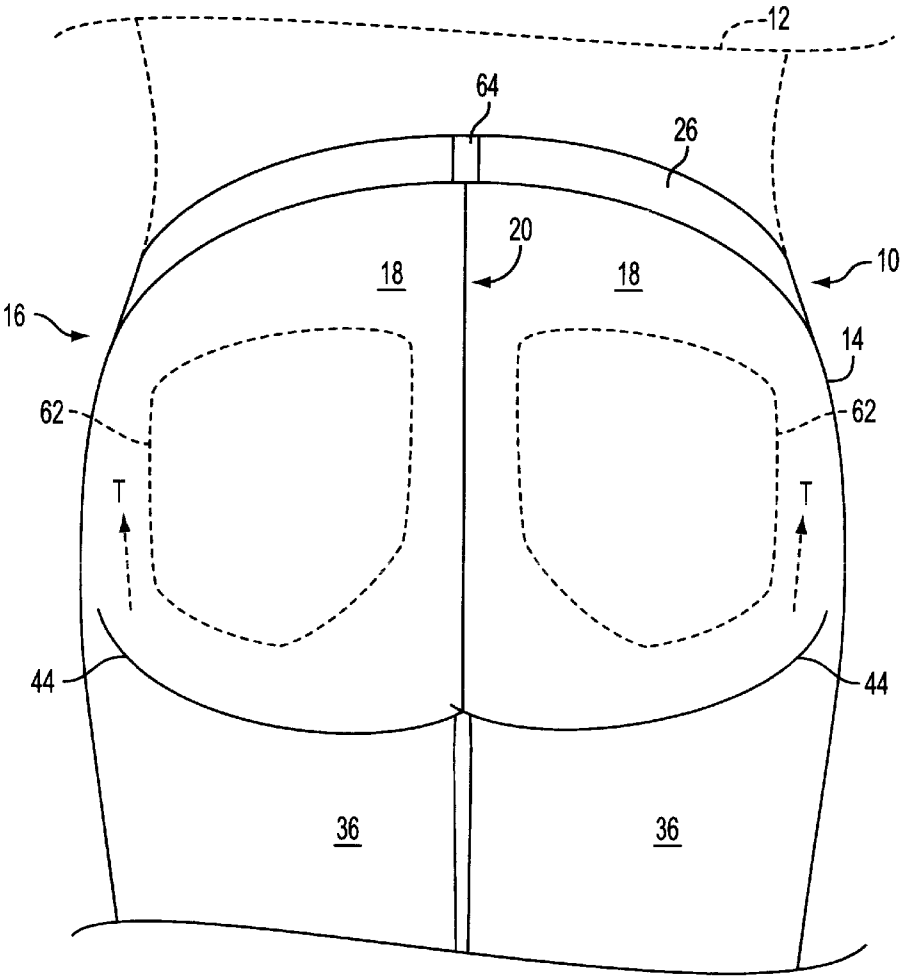
FIG. 4 is a schematic partial rear elevational view of an embodiment of the pants garment shown in FIG. 1.
Figure 5:
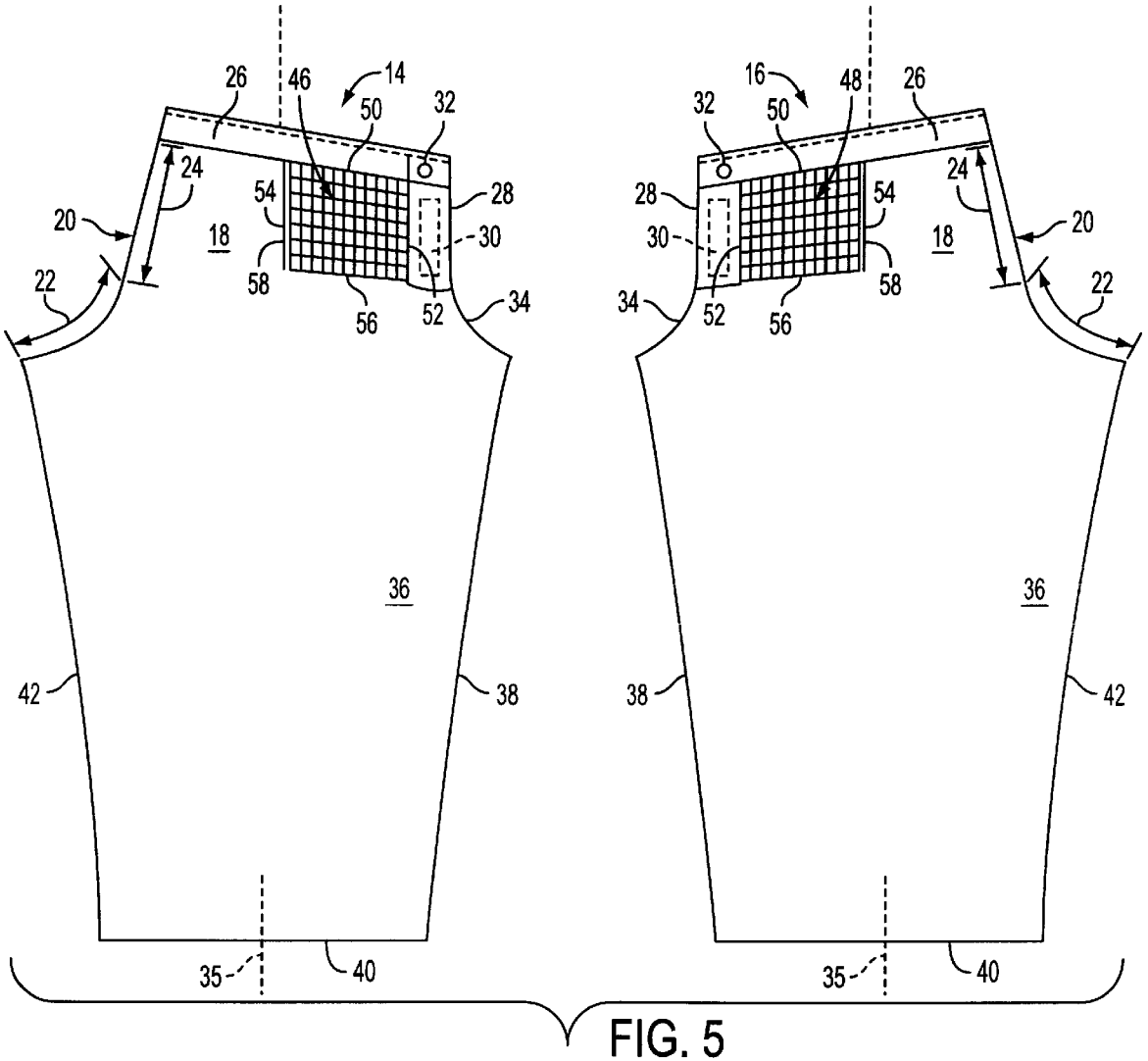
FIG. 5 is a schematic plan view of an embodiment of a two-piece textile pattern for constructing a pants garment according to the teachings of the present invention.

To provide a better understanding of the inventive pants garment 10, a preferred embodiment is described in more detail herein. Referring to FIGS. 3, 4 and 5, pants garment 10 preferably has a general two-piece construction that comprises a left pants section 14 and a right pants section 16 which are joined together so that the pants garment can fit a human body. The left pants section 14 and the right pants section 16 are preferably both cut from a single panel of the fabric, although multi-piece sections are possible. While the entire garment can be formed of solely the two pieces of material, it will in the preferred construction include at least waistband 26 encircling the wearer lower torso. Moreover, pants garment 10 may also include secondary pieces of material to form pockets, belt loops, yokes, etc. The pants garment 10 may be constructed of a wide range of woven fabric such as denim, corduroy or other fabric, but in the most preferred construction is made from a shape recovery fabric.

As used herein a "shape recovery fabric" is a fabric that can be placed in tension and upon release, the fabric springs back to its original shape. In one case, a shape recovery fabric may be stretched linearly 50%–60% along a planar axis and return to its original shape. In a preferred arrangement, a shape recovery fabric may be implemented which has a blend of substantially inelastic material and elastic fibers. For example, the inelastic material may comprise cotton or leather. Nevertheless, other inelastic fibers may be implemented in the shape recovery fabric. The elastic fibers may comprise material sold under the LYCRA® brand. LYCRA® is a trademark of the DuPont Corporation for its brand of a family of premium elastane fiber. In a preferred embodiment, the shape recovery material may include a blend of approximately 98% cotton and 2% elastic fibers or other fabric blends having 2% elastic fibers, such as stretch denim fabric. There are a variety of stretch denim fabric with weave patterns and weights that may be implemented. In one exemplary case, a stretch denim fabric with a weight about 12 ozs per square yard may be used to construct pants garment 10. Other ranges of the weight can be somewhat less than 12 ozs.

The shape recovery fabric may also be constructed in a range of weave and knitting patterns to adjust the direction and amount of the elasticity. Accordingly, in one embodiment, a shape recovery fabric for the pants garment 10 may have elastic fibers oriented more in a horizontal direction than in a vertical direction, that is, the material stretches more in one planar axis than in the other generally perpendicular planar axis. In this configuration, the shape recovery material may have more oblique stretch to provide human body-shaping advantages of the pant garment 10.

Referring to FIG. 5, the left pants section 14 and the right pants section 16 each includes a torso region 18 which covers and engages the lower torso region of a wearer of the pants garment 10. The torso region 18 includes a rearwardly disposed center seam edge 20 which has an anatomical shape so to accentuate the gluteal region of a wearer. The center seam edge 20 includes a concave shaped edge 22, which when joined with the corresponding edge of the pants sections 14, 16 enables the assembled torso region 18 to engage the lower portion of the gluteal muscles of a wearer, particularly the gluteus maximus muscles so that the body profile is improved. As seen in FIG. 5, the concave shaped edge has a slope across its length that extends away from the waistband 26 or the top edge of the pants garment. This shaping of the seam helps the rear portions of the right and left section 14, 16 to lift the buttocks or gluteal regions of the wearer of the pants garment 10.

With continued reference to FIG. 5, the center seam edge 20 further includes a gluteal-back edge 24, which extends from the concaved rear edge 22 to incline upwardly towards the top of the garment on the waistband 26. In one aspect, the incline narrows the torso region 18 so that the assembled pants garment 10 fits snuggly on a wearer. The rear edge of the waistband 26 is elevated with respect to a front region 28 of the torso region 18. This arrangement creates a generally angular configuration of the waistband 26 to the wearer's waistline 13 (see FIG. 1). In a preferred aspect, the waistband 26 has its highest point at the top of the center seam edge 20 and its lowest point in the front of the pants garment 10. More fully described herein, the waistband 26 of the pants garment 10 encircles the wearer to assist in the lifting of the gluteal region of the wearer.

The front region 28 of the torso region 18 includes an adjustable fastening system 30, which reliably secures the pants garment 10 on the wearer. The adjustable fastening device may comprise a zipper, buttons and complementary buttonholes or other types of fastening devices used for clothing. The waistband 26 may also have a fixed fastening structure 32 such as a button, hook-loop, etc. A concave shaped crotch seam line 34 extends downwardly from the front region 28 to define a crotch area of the assembled pants garment.

Referring to FIG. 5, extending downwardly from the torso region 18, a leg region 36 functions to cover all or a portion of a leg of a wearer of an assembled parts garment 10. A forward inseam edge 38 of the leg region 36 tapers inwardly from the crotch seam line 34 to bottom edge 40 of the leg region 36. Likewise, the rear inseam edge 42 of the leg section 36 tapers inwardly from the intersection of the rear concaved line 22 downwardly to the bottom edge 40 of the leg section 36. The tapered configuration creates a smooth stylized and slender appearance of the pants garment on a wearer. Of course, the bottom edge 40 may be hemmed for the assembled pants garment 10 shown in FIG. 3. With continued reference to FIG. 5, a longitudinal axis 35 extends generally parallel to the leg section 36 for the left section 14 and right section 16, respectively. The waistband 26 may be disposed at an acute angle to the longitudinal axis 35 such that the waistband 36 extends away from the leg section 36.

Referring to FIGS. 1 and 4, in a preferred construction, the rear of the pants garment 10 includes a gluteal support region 44. The gluteal support region 44 is formed between the torso section 18 and the leg section 36 when the pants garment is assembled. In one construction, the support region 44 is configured to be located just underneath the lower gluteal region at the thigh of the wearer. In another construction, the concave shaped edge 22 of the center seam 20 extends more inward than conventional pants so that the gluteal support region 44 extends into the anatomy bisecting the two gluteus maximus muscles of the wearer. In these constructions, a support structure is formed so that the pants garment of the present invention supports and elevates the gluteal region of a wearer.

To compress the abdominal region and further elevate the gluteal region of a wearer, the left pants section 14 and the right pants section 16 include resilient panels or webs. In a preferred construction, shown in FIG. 3, the resilient panels 46, 48 are laterally disposed in the interior of the front of the pants garment 10. Referring to FIGS. 1, 3 and 5 each resilient panel 46, 48 includes a top edge 50, a forward edge 52, a rearward edge 54 and a free edge 56 opposed to the top edge 50. The top edge 50 is attached to the waistband 26. The respective forward edge 52 of each panel 46, 48 is attached the front region 28 of each torso region 18 along the front seam or in conjunction with the fastening or securing device 30. The rearward edge 54 is preferably attached to a dart portion 58 in the interior of each torso region 18. To permit movement of the fabric of the pants garment, the free edge 56 hangs freely and is not attached. Nevertheless, the attachment of the panels 46, 48 to the torso region 18 may be accomplished through conventional methods, such as stitching, chemical fusing, or adhesive bonding, etc.

The resilient panels 46, 48 are preferably made from a woven sheet material. The elastic behavior may be accomplished by using woven elastic fibers. In a preferred embodiment, the resilient panels 46, 48 are constructed from synthetic elastic fibers chiefly made from polyurethane, e.g., spandex. Suitable synthetic fibers can include LYCRA® by the DuPont Co., CLEERSPAN® by the Globe Manufacturing Co. or another type of commercially available spandex fiber. Nevertheless, resilient panels 46, 48 may also include other types of fibers to achieve desired characteristics for the pants garment. Alternatively, the panels 46, 48 may be constructed from a range of weave and knit patterns to vary the direction and amount of the elasticity of the resilient panels. In a preferred construction, the material may be woven to provide equal four-way stretch capabilities, meaning that it stretches equally along all four planar axes. Alternatively, the woven elastic material may be formed so that it stretches more in one direction than another direction, such as allowing the material to stretch more or less in an oblique direction with respect to the planar axes as defined by the rear edge 54 and free edge 56.

With reference to FIGS. 1 and 3, on a wearer of the pants garment 10, the resilient panels 46, 48 lengthen to so as to become taut between the front edge 52 and rear edge 54. To accomplish the tautness, the front region 26 of the left and right sections 14, 16 are brought towards each other into mating engagement and secured via the adjustable fastening device 30. In a preferred embodiment, the fastening device 30 may include a conventional front fly zipper fastening system 61. Of course, other constructions are possible to provide the tautness of the panels. Nevertheless, the rear edge 54 of the panels 46, 48 biases the dart portion 58 towards the front seam of the garment 10, which creates a stretching force on the fabric of the pants garment 10. In this way the panels tend to pull the user's stomach in and works to further push the buttocks upwardly.

In one construction implementing a shape recovery fabric with more horizontal stretch than vertical stretch, the resilient panels 46, 48 create a generally oblique lifting force "T" on the torso region 18 and the corresponding the leg region 36 (see FIGS. 1 and 2). The lifting force stretches the shape recovery fabric so that the gluteal support region 44 of the left section 14 and right section 16 is biased upwardly, particularly in an inward oblique direction. This action causes the two gluteus maximus muscles to spread laterally away from each other to further lift and define the rear profile of wearer.

Additionally, the lower abdominal region of the wearer is compressed inward by the resilient panels and the waistband stretches to engage the torso of the wearer. In a preferred construction, left pants section 14 and the right pants section 16 being cut from a single panel of the fabric advantageously creates an uninterrupted stretch surface encircling the leg from inseam edge 42 to inseam edge 38. This configuration facilitates improved force transfer for lifting the gluteal region over a pants garment with inner and outer seams. The wearer is thus provided with an improved physical profile including emphasizing a rear body profile by lifting and supporting the lower gluteal region of the wearer. Moreover, the two pieces constructed without outer seams creates and an attractive streamlined appearance in the garment and when coupled with a shape recovery material an appearance of a natural fit on the wearer.

In an alternative embodiment, the resilient panels 46, 48 may be removable or interchangeable from the pants garment 10. The removability or interchangeability provides the manufacturer with options to supply the resilient panels 46, 48 in different elasticity ratings. In one aspect, different resilient panels may be used to control the amount of lifting of the gluteal region of a wearer. For example, a wearer may desire a pants garment having a relatively high raising feature. The wearer can replace the resilient panels 46, 48 with different types having a higher stretching force rating. This interchangeable feature may be accomplished in numerous ways. One such way may be to use a mechanical fasteners system on the forward edge 52, the top edge 50 and the rearward edge 54 of the panels. For example, thin conventional zippers (not shown) may be sewn into the torso sections 18 and corresponding edges of the resilient panels for interchangeability. Of course, other fasteners for clothing apparel may be used, such as male/female snaps, etc.

Figure 6:
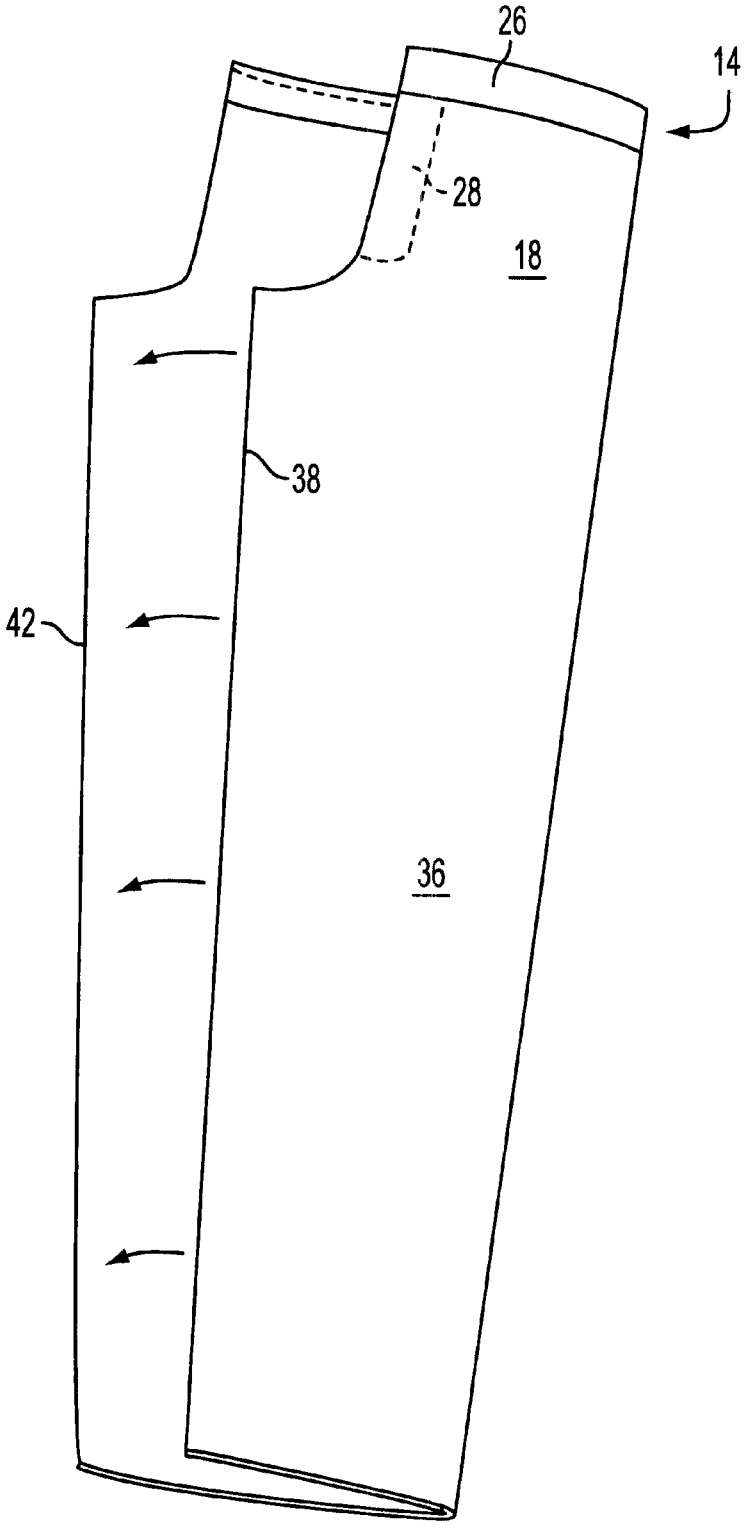
FIG. 6 is a schematic perspective view of a textile pattern shown in FIG. 5 in a process of assembling a pants garment of the present invention.

Referring to FIGS. 5 and 6, for ease of explanation of the preferred embodiment, the garment is assembled starting with the left section 14. Of course, the right section 16 may be assembled first. Nevertheless, in the left section 14, the forward inseam edge 38 and the rear edge 42 of the leg section 36 are sewn together which creates a tube-like extension to receive the leg of a wearer having only an inner seam. Likewise, in the right section 16 of the pants garment 10, the forward inseam edge 38 and the rear inseam edge 42 are similarly sewn together. Then, the rear joining edge 20, in the torso region 18 of the left section 14 and the right section 16 are sewn together. Finally, the crotch curve 34 of the torso regions 18 are sewn to complete the pant garment 10. In this way, the manufacturing efficiencies for the pants garment 10 can be realized by reducing assembly time by 40%–50% over four-piece pants constructions having an outseam and an inseam.

Referring to FIG. 4, the pants garment 10 may include pockets 62 on the rear. Of course, pockets may also be included of the front of the pants garment. Further, the waistband 26 may include a belt carrier system 64 having a plurality of loops of fabric. In addition, a yoke (not shown) may be added to the rear of the pants garment.

Thus, a pants garment enhances the anatomic shape of a lower torso of a human body and provides an improved fit. A preferred aspect of the invention, the pants garment provides an enhanced profile with a natural appearance of the fit on the body and a high level of comfort. While the present invention has been described with reference to preferred embodiments, there are any number of alternative combinations for defining the invention, which incorporate one or more elements from the specification, including the description, claims, and drawings, in various combinations or sub combinations. Accordingly, the use of any or all of the aspects of the invention in a pants garment provides an improved anatomical profile for the wearer.

It will be understood by those of ordinary skill in the art that various changes may be made and equivalents may be substituted for elements without departing from the scope of the invention. In addition, many modifications may be made to adapt a particular feature or material to the teachings of the invention without departing from the scope thereof. Therefore, it is intended that the invention not be limited to the particular embodiments disclosed, but that the invention will include all embodiments falling within the scope of the appended claims.

We claim:

1. A pants garment, comprising:

a right section and a left section each including a torso portion, the torso portions being attached at a rear seam extending from a crotch portion to a waist portion to cover a lower torso region of a wearer, the waist portion being highest at the top of the rear seam and lowest at a front seam of the torso region, the right and left sections each further including a leg portion extending from the torso portion to cover at least a portion of a wearer's leg, the leg portions each having a tubular construction with a single seam along an inner side thereof, and a fastening system to releasably secure the right and left sections together along a front seam.

2. The pants garment of claim 1, wherein the right and left sections each include a first edge along the torso portion that are attached together at the rear seam, the first edge includes a concave curved segment in the crotch portion having a slope that extends away from the waist portion and a generally linear segment connecting the concave curved segment to the waist portion.

3. The pants garment of claim 2, wherein each of the right and left sections has a longitudinal axis extending generally parallel to the leg portion, and wherein the generally linear segment is inclined relative to the inner seam of respective the leg portion.

4. The pants garment of claim 1, wherein each of the right and left sections are composed of a shape recovery material.

5. The pants garment of claim 4, further including a right elastic panel and a left elastic panel, the right elastic panel being attached to a front of the torso portion of the right section and the left elastic panel being attached to a front of the torso portion of the left section, the fastening system being operable to releasably secure the left section and right sections together along the front seam so that right elastic panel and the left elastic panel are tensioned to push against a lower abdominal region of a wearer and to obliquely raise a gluteal region of a wearer.

6. The pants garment of claim 1, further including a right elastic panel and a left elastic panel, the right elastic panel being attached to a front of the torso portion of the right section and the left elastic panel being attached to a front of the torso portion of the left section, the fastening system being operable to releasably secure the left section and right sections together along the front seam so that right elastic panel and the left elastic panel are tensioned to push against a lower abdominal region of a wearer and to obliquely raise a gluteal region of a wearer.

7. The pants garment of claim 1, further including a torso engaging band attached to the waist portions of the right and left sections.

8. The pants garment of claim 1, wherein the right and left sections are each formed as a single piece of material.

9. A pants garment composed of a shape recovery material, comprising:

a torso portion having a torso engaging band, a right section and a left section, the right and left sections being attached at a rear seam extending from a crotch portion to the torso engaging band so that the torso portion covers a lower torso region of a wearer, the torso engaging band being highest at the top of the rear seam at lowest at a front seam of the torso region;

a right leg portion extending from the right section of the torso portion so as to cover at least a portion of a right leg of a wearer;

a left leg portion which extends from left section of the torso portion so that at least a portion of a left leg of a wearer is covered;

a right elastic panel and a left elastic panel, the right elastic panel being attached to a front portion of the right section and the left elastic panel being attached to a front portion of the left section; and a right securing portion along the front section along the front seam and a left securing portion in the front section along the front seam, the right and left securing portions collectively defining a fastening system, the fastening system being operable to releasably secure the left section and right section together along the front seam so that right elastic panel and the left elastic panel are tensioned to push against a lower abdominal region of a wearer and to obliquely raise a gluteal region of a wearer.

10. The pants garment in accordance with claim 9, in which the right and left sections each have a first edge which are attached together to form the rear seam, each first edge includes a concave curved segment in the crotch portion wherein the slope of the curved segment extends away from the torso engaging band and an inclined segment that extends from the curved segment to the torso engaging band to lift and accentuate the gluteal region of a wearer.

11. The pants garment in accordance with claim 10, in which the right elastic panel and left elastic panel each have a top edge, a rear edge, a front edge and a free edge, wherein the top edge is attached to the torso engaging band, the rear edge is attached along a side of the torso portion, and the front edge is attached along the front seam.

12. The pants garment in accordance with claim 11, in which the shape recovery material has a stretch bias, which is greater in a horizontal direction than in a vertical direction.

13. The pants garment in accordance with claim 12, in which the sides of the torso portion include darts extending from the torso engaging band, wherein the rear edge of the elastic panels are attached in the darts.

14. The pants garment in accordance with claim 13, in which the right leg portion and the left leg portion each have a continuous surface encircling the right leg and the left leg of a wearer extending from a right inseam of the right leg portion and a left inseam of the left leg portion.

15. The pants garment in accordance with claim 14, in which the shape recovery material includes synthetic elastic fibers and inelastic fibers.

16. The pants garment in accordance with claim 9, in which the right elastic panel and left elastic panel each have a top edge, a rear edge, a front edge and a free edge, wherein the top edge is attached to the torso engaging band, the rear edge is attached along a side of the torso portion, and the front edge is attached along the front seam.

17. The pants garment in accordance with claim 9, in which the shape recovery material has a stretch bias which is greater in a horizontal direction than in a vertical direction.

18. The pants garment in accordance with claim 9, in which the sides of the torso portion include darts extending from the torso engaging band, wherein the rear edge of the elastic panels are attached in the darts.

19. The pants garment in accordance with claim 9, in which the right leg portion and the left leg portion each have a continuous surface encircling the right leg and the left leg of a wearer extending from a right inseam of the right leg portion and a left inseam of the left leg portion.

20. The pants garment in accordance with claim 9, in which the shape recovery material includes synthetic elastic fibers and inelastic fibers.

21. The pants garment in accordance with claim 9, in which the right elastic panel and the left elastic panel are removably attached to the torso portion.

22. A pants garment, comprising:

a torso section which encircles a lower torso of a wearer, the torso section being higher in a rear than in a front of the lower torso to create a top portion of the torso section which has a generally angular configuration with respect to a waistline of a wearer;

a first leg section extending from the torso section which receives a first leg of a wearer, the first leg section having a first inseam on one side of the first leg section and being seamless on the opposing side of the first leg section;

a second leg section extending from the torso section which receives a second leg of a wearer, the second leg section having a second inseam on one side of the second leg section and being seamless on the opposing side of the second leg section;

a front region of the torso section including two laterally disposed resilient webs each having a top edge, a front edge, a rear edge and a free edge opposed to the top edge in which the top edge is attached to the top portion of the torso section, the front edge is attached to a front seam of the torso section, and the rear edge is attached to a dart portion in the interior of the torso section; in which the resilient webs substantially compresses an abdominal region of a wearer and elevates a gluteal region of a wearer when each of the webs are biased between the front edge and the rear edge.

23. The pants garment in accordance with claim 22, in which the torso section includes an anatomically curved rear seam adapted to join the first leg section to the second leg section so that the gluteal region of a wearer is raised.

24. The pants garment in accordance with claim 22, wherein the torso section, the first leg section, and the second leg section are composed of a shape recovery material being stretchable more in a horizontal direction than in a vertical direction.

25. The pants garment in accordance with claim 24, wherein the shape recovery material is a blend of substantially inelastic fibers and elastic fibers.

26. The pants garment in accordance with claim 25, wherein the inelastic fibers comprises cotton and the elastic fibers comprises elastane.

27. The pants garment in accordance with claim 22, in which the front region of the torso section includes a fastening system adapted to close a front seam of the torso section and to bring the front edge of each web towards each other so as to bias the front edge of each web relative to the rear edge of each web.

28. A pants garment, comprising:

a right section and a left section each formed from a single piece of material and each having a torso region and a leg region, the torso region having a front edge, a rear edge and a waist edge interconnecting the front and rear edges, the rear edge including a concave curved segment adjacent the leg region, the concave curved segment having a slope extending away from the waist edge, and a generally linear segment connecting the concave curved segment to the waist edge, the rear edges of each single piece being connected along a rear seam, the leg region having a first side edge and a second side edge that are interconnected along an inner seam, and a fastening device for releasably securing the front edges together.

29. The pants garment of claim 28, wherein each of the single pieces of material has a longitudinal axis extending generally parallel to the leg region, and wherein the generally linear segment is inclined relative to the inner seam of respective the leg portion.

30. The pants garment of claim 29, wherein the waist edge is at an acute angle to the longitudinal axis such that the waist edge is extending away from the leg region as the waist edge extends toward the rear edge, so that the waist is highest at the rear seam and lowest at the front edges.

31. The pants garment of claim 28, including a torso portion covering a lower torso of a wearer, the torso portion comprising the torso regions of the single pieces of material and at least one other secondary piece of material.

32. The pants garment of claim 31, wherein the at least one other secondary piece of material includes a waistband.

33. The pants garment of claim 31, wherein the single pieces of material are each composed of a shape recovery material.

34. The pants garment of claim 33, wherein the at least one other secondary piece of material includes elastic panels secured along a front portion of the torso portion, each elastic panel having a first edge attached to the waistband, a second edge attached adjacent the fastening device and a third edge attached along a mid portion of the single piece of material, the fastening system being operable to releasably secure the left section and right sections together along the front seam so that the right elastic panel and the left elastic panel are tensioned to push against an abdominal region of a wearer and to raise a gluteal region of a wearer.

35. The pants garment of claim 28, wherein the single pieces of material are each composed of a shape recovery material.

* * * * *

US006543062C1

(12) INTER PARTES REEXAMINATION CERTIFICATE (0350th)

United States Patent

Amsel et al.

(10) Number: US 6,543,062 C1

(45) Certificate Issued: Mar. 6, 2012

(54) PANTS GARMENT WITH BODY PROFILE ENHANCEMENT FEATURES

(75) Inventors: Fortuna Amsel, Caracas (VE); Simon Amsel, Carcas (VE)

(73) Assignee: Corporation 1466, C.A., Colinas de Bello Monte, Caracas (VE)

Reexamination Request:
No. 95/000,504, Jan. 19, 2010

Reexamination Certificate for:

| | |
|---|---|
| Patent No.: | **6,543,062** |
| Issued: | **Apr. 8, 2003** |
| Appl. No.: | **10/093,968** |
| Filed: | **Mar. 11, 2002** |

(51) Int. Cl.
*A41D 1/06* (2006.01)

(52) U.S. Cl. ..... 2/227; 2/237

(58) Field of Classification Search ..... 2/227
See application file for complete search history.

(56) References Cited

To view the complete listing of prior art documents cited during the proceeding for Reexamination Control Number 95/000,504, please refer to the USPTO's public Patent Application Information Retrieval (PAIR) system under the Display References tab.

*Primary Examiner*—Catherine S. Williams

(57) ABSTRACT

A pants garment may be formed with a high back and low front to accentuate the buttocks of the wearer. A pants garment can include elastic panels along a front to draw in the wearer's stomach and pull on the rear to lift the buttocks. The garment can be formed of a shape recovery material that cooperates with the elastic panels to assist in lifting of the buttocks. A pants garment can be formed primarily of two mirror image sections that are interconnected along the front and rear seams. The rear seams may include a concave curved segment in a crotch in which the slope of the curved segment extends away from the waist of the garment. The legs of each section has a tubular configuration with a single seam extending along an inner side. A seamless outer surface cooperates with the shape recovery material to lift the buttocks.

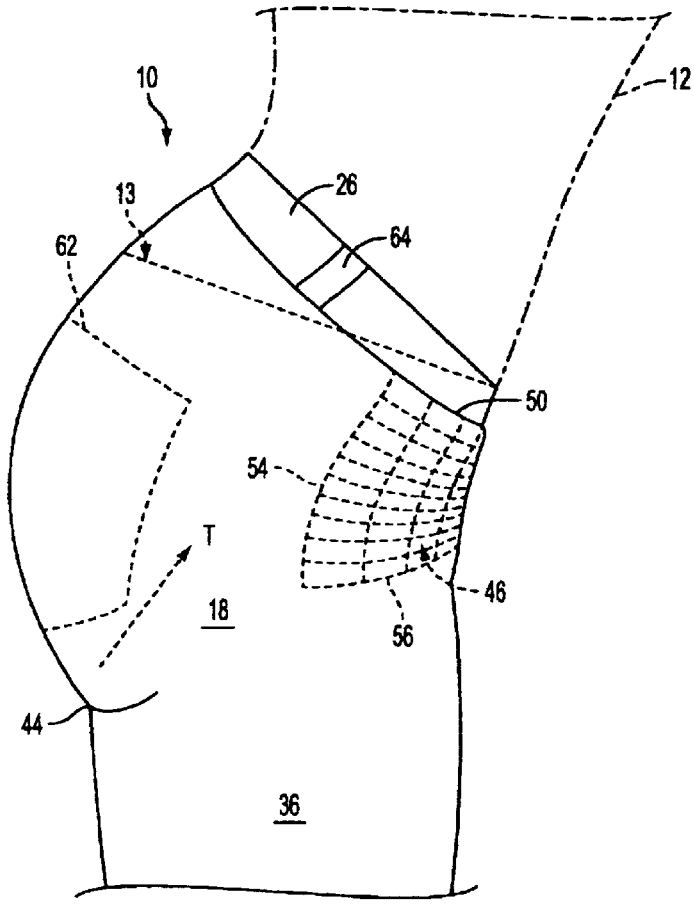

INTER PARTES REEXAMINATION CERTIFICATE ISSUED UNDER 35 U.S.C. 316

THE PATENT IS HEREBY AMENDED AS INDICATED BELOW.

AS A RESULT OF REEXAMINATION, IT HAS BEEN DETERMINED THAT:

Claims 9-21 are cancelled.

Claims 1-8 and 22-35 were not reexamined.

* * * * *